US010202975B2

(12) United States Patent
Doy

(10) Patent No.: US 10,202,975 B2
(45) Date of Patent: Feb. 12, 2019

(54) METHOD FOR DETERMINING CAVITATION IN PUMPS

(71) Applicant: Caterpillar Inc., Peoria, IL (US)

(72) Inventor: Nathaniel Steven Doy, Peoria, IL (US)

(73) Assignee: Caterpillar Inc., Deerfield, IL (US)

( * ) Notice: Subject to any disclaimer, the term of this patent is extended or adjusted under 35 U.S.C. 154(b) by 229 days.

(21) Appl. No.: 15/250,078

(22) Filed: Aug. 29, 2016

(65) Prior Publication Data

US 2018/0058443 A1 Mar. 1, 2018

(51) Int. Cl.
*F04B 51/00* (2006.01)

(52) U.S. Cl.
CPC ..... *F04B 51/00* (2013.01); *F04B 2205/05* (2013.01); *F04B 2205/503* (2013.01)

(58) Field of Classification Search
CPC ..... F04B 2205/05; F04B 2205/503; F04B 51/00; G06F 9/455
See application file for complete search history.

(56) References Cited

U.S. PATENT DOCUMENTS 5,769,608 A * 6/1998 Seale ..... F04B 43/04 417/360
5,772,403 A * 6/1998 Allison ..... F04B 49/065 417/44.2
6,655,922 B1 12/2003 Flek
7,797,142 B2 * 9/2010 Salomon ..... G06F 17/5018 137/565.19
8,401,806 B2 3/2013 Borsting et al.
8,801,393 B2 * 8/2014 Crabtree ..... B60K 25/02 180/305
9,255,578 B2 2/2016 Sharpe, Jr. et al.
2010/0313849 A1 * 12/2010 Stoner ..... F02D 41/22 123/350
2011/0241888 A1 * 10/2011 Lu ..... F04D 15/0077 340/626
2016/0047373 A1 2/2016 Jaeger et al.
2016/0084695 A1 3/2016 Funk et al.

FOREIGN PATENT DOCUMENTS

CN 105203329 12/2015
JP 06159501 6/1994
JP 2008223826 9/2008

* cited by examiner

*Primary Examiner* — Francis C Gray
(74) *Attorney, Agent, or Firm* — Bart A. Fisher

(57) ABSTRACT

A method for determining cavitation in a pump is disclosed. The method includes detecting, by a sensor, a pressure of a fluid pumped by the pump and determining, by a controller, whether the pressure exceeds a pressure range. Cavitation is determined when the pressure exceeds the pressure range. The method includes selectively incrementing or decrementing, by the controller, a counter value of a counter based on determining whether the pressure exceeds the pressure range. The counter value is incremented when the pressure exceeds the pressure range, and decremented when the pressure does not exceed the pressure range. The method includes determining, by the controller, whether the counter value exceeds a threshold value, and generating, by the controller, an alert when the counter value exceeds the threshold value and causing, by the controller, the alert to be displayed via a display.

9 Claims, 4 Drawing Sheets

METHOD FOR DETERMINING CAVITATION IN PUMPS

TECHNICAL FIELD

The present disclosure relates to a system and method for determining cavitation in fluid systems. More particularly, the present disclosure relates to a pump cavitation detection system that generates a cavitation alert based on a noisy pressure signal.

BACKGROUND

Fluid systems, such as hydraulic systems, are known to run controlled streams of fluid within fluid circuits. Gas bubbles may be formed within such streams if, for example, the fluid's fluid pressure drops below the fluid's vapor pressure, or when a pump, powering the fluid flow, draws in air along with the stream of fluid. If a pressure within the gas bubbles recedes below the fluid pressure, such gas bubbles may collapse and implode relatively violently in a process commonly referred to as cavitation. Cavitation generally produces a significant energy acoustic wave that may be sustained by the pump, typically becoming a reason for pump wear.

U.S. Pat. No. 9,255,578 ('578 reference) relates to a system and method to monitor pump cavitation. The '578 reference includes monitoring a pressure parameter and a vibration parameter associated with an asset in an operating process unit. The '578 reference includes calculating a manipulated pressure value and a manipulated vibration value, respectively based on the pressure parameter and the vibration parameter, and determining a state of cavitation associated with the asset based on at least one of the manipulated pressure value or the manipulated vibration value.

SUMMARY OF THE INVENTION

In one aspect, the disclosure is directed towards a method for determining cavitation in a pump. The method includes detecting, by a sensor, a pressure of a fluid pumped by the pump. A controller determines whether the pressure exceeds a pressure range. The controller selectively increments or decrements a counter value of a counter based on determining whether the pressure exceeds the pressure range. The counter value is incremented when the pressure exceeds the pressure range, while the counter value is decremented when the pressure does not exceed the pressure range. The method includes determining, by the controller, whether the counter value exceeds a threshold value. If the counter value exceeds the threshold value, the controller generates an alert, and causes the alert to be displayed via a display.

In another aspect, the disclosure relates to a machine. The machine includes an engine and a fluid system. The fluid system is coupled to the engine and configured to receive a fluid to power a movement of the machine. The fluid system includes a pump, a sensor, a counter, a controller, and a display. The pump is configured to pump the fluid within the fluid system. The sensor is configured to detect a pressure of the fluid being pumped by the pump. The counter is coupled to the sensor and configured to receive the pressure as a pressure signal, and includes a counter value. The controller is coupled to both the sensor and the counter, and is configured to determine whether the pressure exceeds a pressure range. Further, the controller is configured to selectively increment or decrement the counter value based on determining whether the pressure exceeds the pressure range. The counter value is incremented when the pressure exceeds the pressure range, and decremented when the pressure does not exceed the pressure range. Further, the controller is configured to determine whether the counter value exceeds a threshold value, and generate an alert when the counter value exceeds the threshold value. The display is coupled to the controller and is configured to display the alert.

In yet another aspect, the disclosure is directed to a fluid system. The fluid system includes a pump, a sensor, a counter, a controller, and a display. The pump is configured to pump a fluid within the fluid system. The sensor is configured to detect a pressure of the fluid being pumped by the pump. A counter is coupled to the sensor and configured to receive the pressure as a pressure signal. The counter includes a counter value. Further, the controller is coupled to the sensor and the counter. The controller is configured to determine whether the pressure exceeds a pressure range, and selectively increment or decrement the counter value based on determining whether the pressure exceeds the pressure range. The counter value is incremented when the pressure exceeds the pressure range, while decremented when the pressure does not exceed the pressure range. Furthermore, the controller is configured to determine whether the counter value exceeds a threshold value. When the counter value exceeds the threshold value, the controller is configured to generate an alert and display the alert via a display that is coupled to the controller.

DETAILED DESCRIPTION

Figure 1:
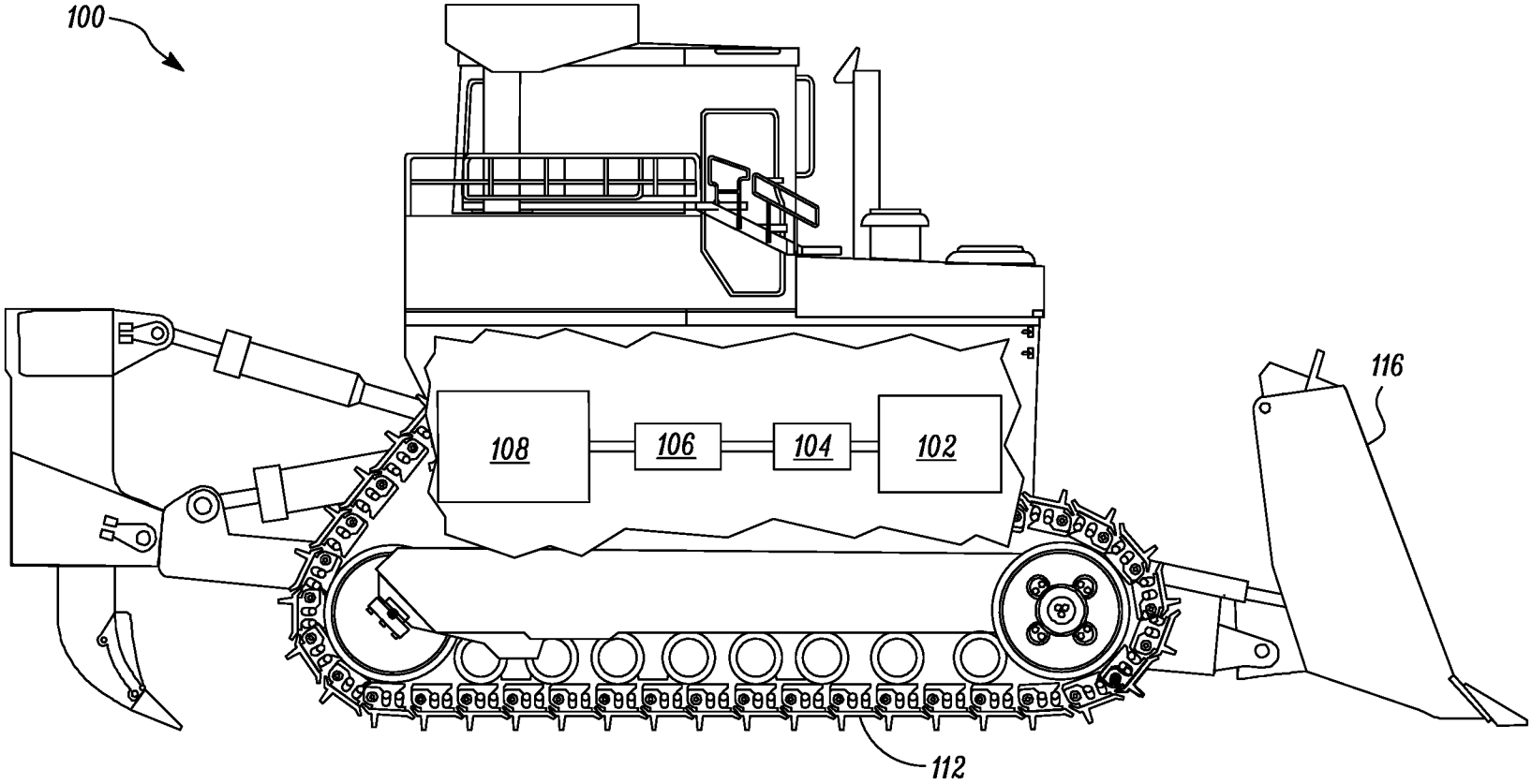
FIG. 1 is an exemplary machine, in accordance with concepts of the present disclosure.

Referring to FIG. 1, a machine 100 is shown. The machine 100 may be a track type tractor. However, aspects of the present disclosure are applicable to a variety of machines, for example, hydraulic excavators, wheel loaders, mining trucks, skid-steer loaders, dozers, general track-type construction machines, wheeled construction machines, and/or the like. Additionally, or alternatively, one or more aspects of the present disclosure may apply to the other types of machines (i.e., different than construction machines) and/or other types of environments. For example, aspects of the present disclosure may apply to stationary power generation units, such as generator sets employing one or more fluidly powered systems. Additionally, or alternatively, aspects of the present disclosure may be extended to various other systems that utilize fluids to power one or more of their functions, such as found in commercial and domestic establishments. The machine 100 may include an engine 102, a torque converter 104, a fluid system 106, and a drivetrain 108.

The engine 102 may be an internal combustion engine coupled to the fluid system 106 via the torque converter 104, as is customary. The fluid system 106 may be coupled to the engine 102 to receive power from the engine 102. The fluid system 106 may be in turn coupled to the drivetrain 108 to transmit a movement imparted by the engine 102 to one or more traction devices 112 of the machine 100, according to a general practice of the art. In some implementations, the torque converter 104 may be connected with the fluid system 106 by a shaft.

Figure 2:
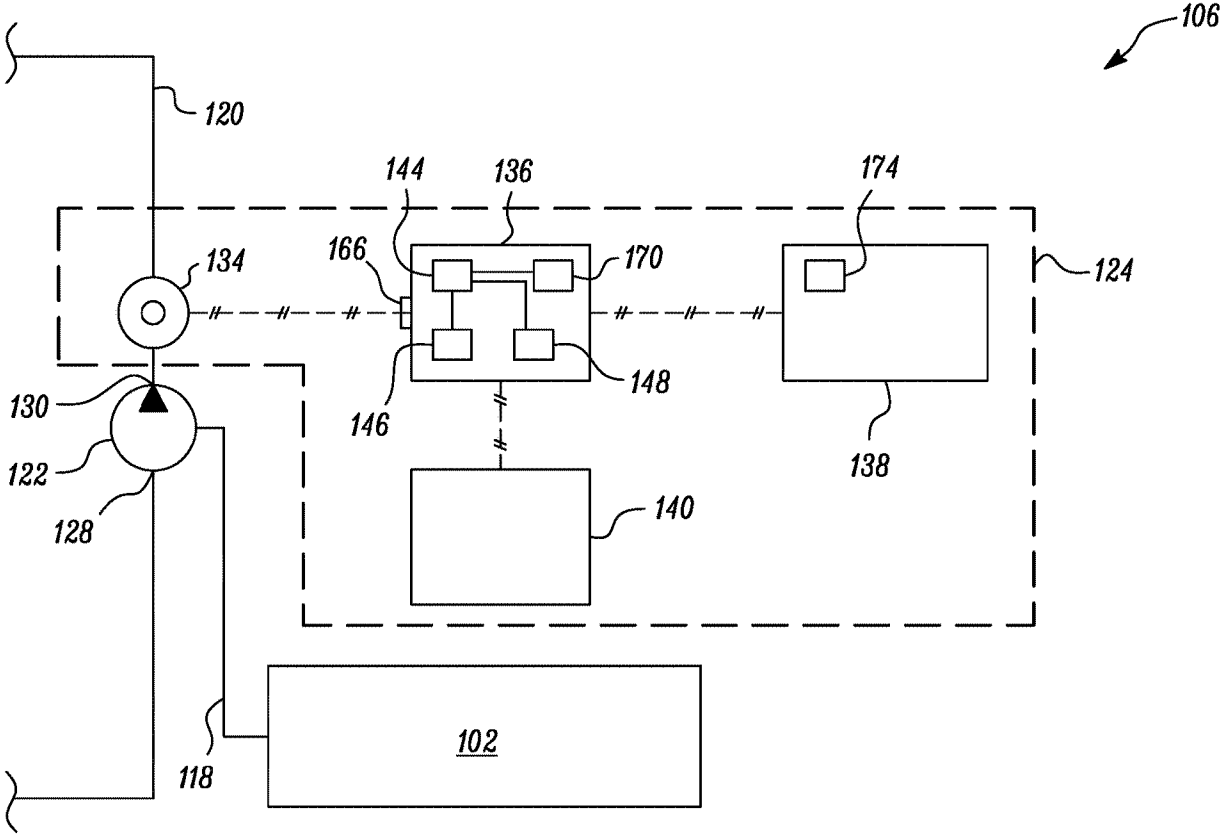
FIG. 2 is a layout of an exemplary fluid system of the machine, having a pump cavitation detection system, in accordance with concepts of the present disclosure.

Referring to FIG. 2, the fluid system 106 may be a transmission system of the machine 100. For example, the fluid system 106 may be a hydraulically operated, automatic transmission system of the machine 100. The fluid system 106 may be coupled to the engine 102, and may be configured to receive a fluid to power a movement of the machine 100. In some implementations, the fluid system 106 may be a hydrostatic transmission system, a hydro-kinetic transmission system, or may include any other known transmission type that may use a fluid for transmitting power from the engine 102, to the drivetrain 108 and the traction devices 112. In some implementations, aspects of the present disclosure may also be applicable to various other fluidly operated systems of the machine 100, for example, a control system to facilitate movement of an implement 116 of the machine 100. The fluid system 106 may include a circuit 120, a pump 122, and a pump cavitation detection system 124.

The pump 122 may be a high-pressure fluid pump fluidly coupled to the circuit 120. The pump 122 may be adapted to pump a fluid within the circuit 120 of the fluid system 106 and help the fluid system 106 perform one or more functions. The pump 122 may include an inlet 128 and an outlet 130. The inlet 128 may be configured to draw the fluid, for example from a fluid sump (not shown) of the fluid system 106 (such as may be found in transmission systems) or from a reservoir (not shown). The outlet 130 may be adapted to release and circulate the fluid throughout the circuit 120 to execute one or more functions associated with the fluid system 106. For this purpose, a variety of valves (not shown) may be associated with the circuit 120 as well and may function according to certain parameters and pressurization provided by the pump 122. In some implementations, the pump 122 may be a variable displacement pump, a fixed displacement pump, or other pump-types, as has been well known and applied in the art.

In some implementations, the pump 122 may be a primary power source of the fluid system 106, and may be driven by the engine 102. To this end, the pump 122 may be coupled to the engine 102 by a countershaft link 118, although the pump 122 may be coupled to the engine 102 in an alternative manner. For example, the pump 122 may be coupled to the engine 102 through a belt drive mechanism, an electrical circuit, and/or the like. In some implementations, the pump 122 may be indirectly connected to the engine 102. For example, the pump 122 may be indirectly connected to the engine 102 through a torque converter and/or through a reduction gear box.

In one example, the pump 122 may be adapted to provide fluid to the torque converter 104 at an appropriate pressure. To this end, the pump 122 may be a gear pump, (although various other pump types may be contemplated, as aforementioned), which may depend upon an application of the fluid system 106. In some examples, the pump 122 may be used to perform power movement of actuators of machines, such as booms and linkages that are commonly found in construction machines.

The pump cavitation detection system 124 (hereinafter "system 124") may be configured to detect conditions when the fluid experiences pressure variations at any given point in the circuit 120. Such detection may help determine if a 'cavitation condition' is existent within the pump 122. For purposes of the present disclosure, the term 'cavitation condition' may be referred to as a state when a pressure of the fluid may be in variance from a nominal pressure (or when the pressure of the fluid varies from the nominal pressure) under which the fluid generally operates to perform useful work. In some implementations, a presence of low fluid pressure within the fluid system 106 may suggest a presence of a low fluid level within the fluid system 106. As a result, a determination of a cavitation condition may also determine a fluid level of the fluid system 106, and, accordingly, determine whether the fluid level is below a threshold fluid level (e.g., a low fluid level). In this regard, the system 124 may notify an operator regarding the fluid level. For example, the system 124 may notify the operator when the fluid level is below the threshold fluid level. Therefore, the system 124 may also be interchangeably referred to as a fluid level detection system. The system 124 may include various components. These components may include a sensor 134, a controller 136, a counter 138, and a display 140. The components may be implemented using hardware, software, and/or a combination of hardware and software. In some implementations, the components may be interconnected using wired connections, wireless connections, and/or a combination of wired connections and wireless connections.

The sensor 134 may be coupled to the circuit 120 and may be configured to detect a pressure (or a pressure signal) of the fluid flowing through the circuit 120. In some implementations, the sensor 134 may be coupled to the outlet 130 of the pump 122 and may be adapted to generate a pressure signal indicative of a fluid pressure at said outlet 130. In some implementations, the sensor 134 may be located within the pump 122 or located at a point further upstream of the outlet 130. For example, the sensor 134 may be mounted on an outer surface of transmission fluid hoses (not shown) in the flow of the fluid. In this regard, the sensor 134 may determine a pressure at which a volume of fluid is being pumped by the pump 122. In some implementations, the sensor 134 may include multiple sensor units that may be positioned at multiple locations of the circuit 120 and may detect a pressure of the fluid at the multiple locations. For example, one or more of the sensor units may be positioned upstream with respect to the outlet 130. In this regard, an overall pressure or representative pressure could be computed using the multiple sensor units for use with the controller 136. In some implementations, the controller 136 may use a set of instructions to determine one or more of the sensor units to use and to determine when to use the one or more of the sensor units. In some implementations, the use of one or more sensor units may be determined based on a preset selection pattern stored within the controller 136. In some implementations, the controller 136 may determine the sensor units to use depending upon a sensitivity of the sensor units and/or a viscosity or a temperature of the fluid applied within the circuit 120.

In some implementations, the sensor 134 may be a capacitive sensor, which may detect multiple parameters, such as a temperature, a flow rate, a viscosity, and/or the like, of the fluid within the fluid system 106. The multiple parameters may include a pressure signal (indicating a pressure of the fluid) which may be transmitted to the controller 136 for processing. In some implementations, the sensor 134 may be a pressure transducer or an analog device that is adapted to convert a detected pressure signal into an electrical (or voltage) signal, and transmit the electrical signal to the controller 136, so as to be processed by the controller 136. In general, the sensor 134 may work on a Wheatstone bridge principle that may source power from an existing or a surrounding equipment, such as an Electronic Control Unit (ECU) of the machine 100.

The controller 136 may be coupled to the sensor 134 and may be in data communication with the sensor 134. In this manner, the controller 136 may be configured to receive a pressure signal indicating a pressure of the fluid (such as in the form of an electrical signal) from the sensor 134. The controller 136 may include a programmable electronic circuit that may be set to perform a task of processing the pressure signal obtained from the sensor 134 and converting the signal to a processed signal. For example, the controller 136 may include a purpose-built processor (or simply a processor 144), and the task may involve a conversion of the pressure signal into digital information readable by the counter 138. To perform this conversion, the controller 136 may be configured to run a system logic that may be stored in the form of the set of instructions in a memory 146 of the controller 136, and which may be retrieved as and when a signal conversion is required. The set of instructions may be a system logic according to which a pressure variance from a nominal pressure of fluid operation may be detected, the counter 138 may be varied, and/or a cavitation condition may be detected. In some implementations, the controller 136 may include a conversion module 148 that may be dedicated to transform an incoming signal waveform to a format usable by one or more elements of the fluid system 106. In some implementations, the controller 136 may receive a pressure signal from an alternate source, such as a separate algorithm, to be processed by the set of instructions.

The processor 144 may be programmed to perform several logical operations as may be directed by the set of instructions to establish a processed signal. The processor 144 may be coupled to the memory 146 by way of an electronic circuit, so that the processor 144 may retrieve the set of instructions from the memory 146, every time signals from the sensor 134 need to be processed.

The controller 136 may also be coupled to the counter 138 and the display 140, and may be in data communication with each of the counter 138 and the display 140. In general, links between the controller 136 and each of the sensor 134, the counter 138, and the display 140, may be wired and/or wireless connections, or by conventionally available telemetry devices. In some implementations, there may be a two-way communication between the controller 136 and the counter 138. Such a two-way communication between the controller 136 and the counter 138 may enable a signal processed within the controller 136 to be transmitted to the counter 138. In turn, the counter 138 may be configured to generate a response signal (indicating a counter value of the counter 138) based on the processed signal from the controller 136. The response signal may be returned to the controller 136 to be further processed. If the counter value exceeds a threshold value (discussed further below), the controller 136 may transmit an alert signal to the display 140 in a suitable format. To accomplish such functions, the controller 136 may also include a trans-receiver module, which may facilitate transmission and reception of signals, in a manner as has been noted above.

The memory 146 may be configured to store information such as the set of instructions. The memory 146 may be a main memory of the controller 136, or may be an entity independent of the controller 136. For example, the memory 146 may be a portable memory device that may be applicable when the system 124 is installed in the machine 100 as a kit. In some implementations, therefore, the memory 146 may be an external storage device such as hard drives, pen drives, flash drives, and/or the like. The memory 146 may include volatile and non-volatile memory units, such as dynamic random access memory (DRAM), static random access memory (SRAM), read only memory (ROM), programmable read only memory (PROM), erasable programmable read only memory (EPROM), electric erasable programmable read only memory (EEPROM), and/or the like.

Figure 3:
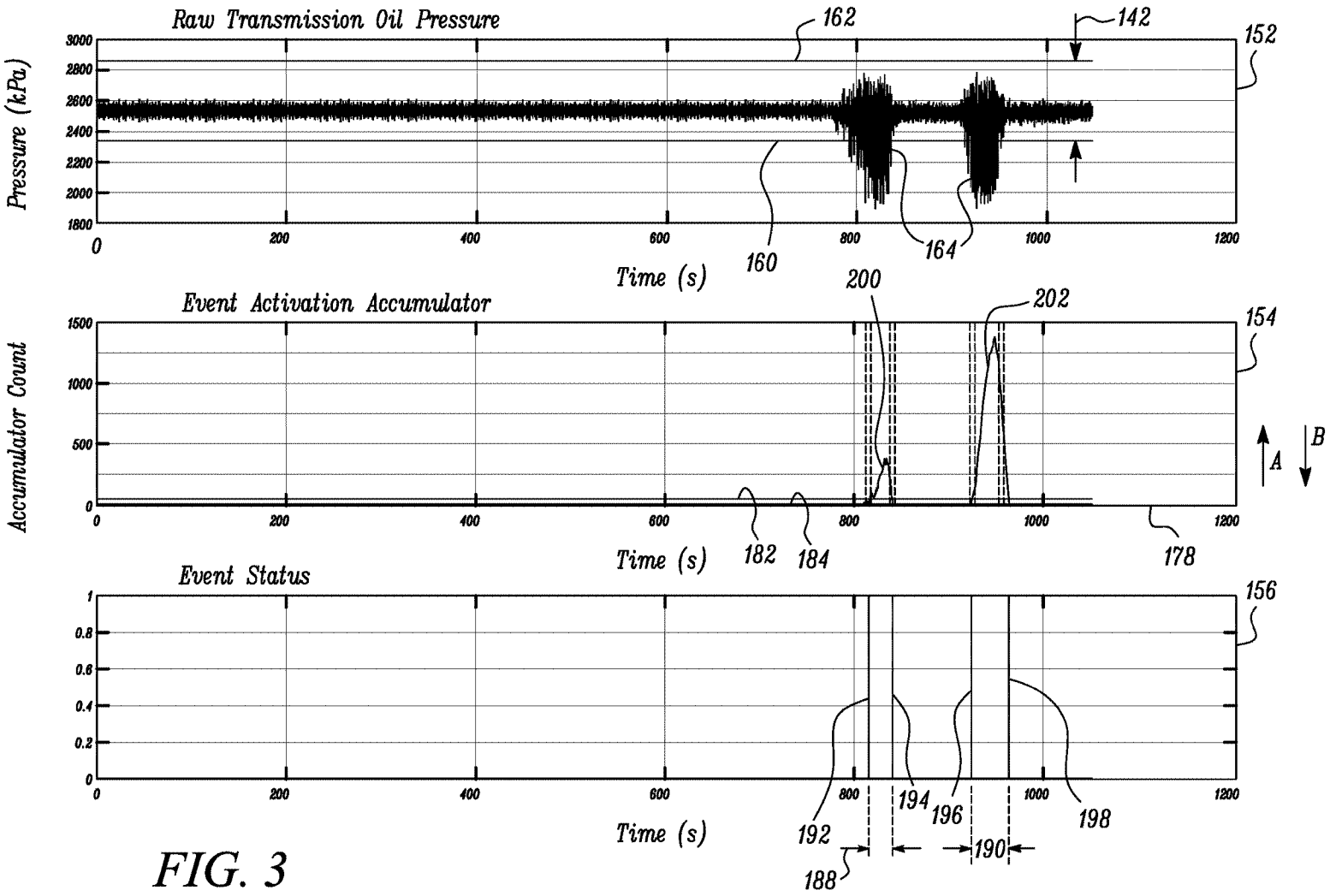
FIG. 3 is a graphical view depicting pressure fluctuations sustained by a fluid of the fluid system, and graphical depictions of associated responses calibrated by the pump cavitation detection system, in accordance with concepts of the present disclosure.

Referring to FIG. 3, the set of instructions may include a data that may be generated and stored as charts (first chart 152, second chart 154, and third chart 156) within the memory 146, and with the help of which, the system 124 may detect a 'cavitation condition' existent within the pump 122, or in general, within the fluid system 106. The first chart 152 and the second chart 154 may respectively represent pressure and count variations relative to time, while the third chart 156 may represent an event status data, also denoted with respect to time. Such charts may help the controller 136 ascertain a pressure range 142 (see first chart 152) within which it may be acceptable for the fluid to operate in, and related to which every processed signal may be analyzed and compared with. The pressure range 142 may include a lower threshold limit 160 and an upper threshold limit 162, as shown. For example, the lower threshold limit 160 and the upper threshold limit 162 may respectively and exemplarily be around 2300 kilopascal (kPa) and 2900 kPa, (see first chart 152). This pressure range 142 may be determined as a factor of a nominal pressure of operation of the fluid. For example, the pressure range 142 may be 10% of the nominal pressure of operation of the fluid. A variation to this factor may be possible.

Each pressure signal detected by the sensor 134 may be processed and analyzed according to the pressure range 142 by the controller 136. Accordingly, a variation in pressure of the fluid, termed as a common pressure noise, may be detected generally throughout a cycle of operation of the fluid system 106. However, if a set of processed signals are noted to exceed the pressure range 142, those pressure signals may be unacceptable, and a noisy pressure signal or an "unacceptable pressure noise 164" (see first chart 152) may be detected by the controller 136 and, accordingly, a cavitation condition may be occurring within the fluid system 106. Based on the unacceptable pressure noise 164, information (e.g., a report) may be generated by the controller 136, so that the controller 136 may vary (e.g., increment or decrement) the counter value of the counter 138. According to an example of the present disclosure, the counter value may be incremented by a first amount or an increment amount (e.g., 100) or, alternatively, the counter value may be decremented by a second amount or a decrement amount (e.g., 20). Further, as the controller 136 may detect an unacceptable pressure noise (such as unacceptable pressure noise 164), the controller 136 may also generate an alert (or alert signal) when the counter value exceeds a threshold value. Such an alert may be transmitted to the display 140 to be displayed to the operator, or optionally the alert may be logged on an ECM of the machine 100 or the controller 136, or may be transmitted to a back office that may monitor the cavitation condition.

Variations to the above mentioned numerical data may be possible, and may depend upon multiple factors, such as ranging from a viscosity of the fluid used, to a sensitivity of the components associated with the circuit 120, and certain machine characteristics, such as an engine capacity of the machine 100. Such variations may be determined and set, for example during assembly, service, or repairs. These variations may also vary from application to application. Therefore, it should be understood that these values are meant for illustrative purposes alone, and none of these values, whether mentioned supra or infra, need to be seen as being limiting in any way.

Referring to FIGS. 2 and 3, the controller 136 may form a portion of any existing control module of the engine 102 that may be configured to perform a variety of tasks. In some implementations, the controller 136 may include power electronics, preprogrammed logic circuits, data processing circuits, associated input/output buses, volatile memory units, such as random access memory (RAM) to help process signals received from the sensor 134. To this end, the controller 136 may be a microprocessor based device, or may be implemented as an application-specific integrated circuit, or other logic devices, which provide controller functionality, and such devices being known to those with ordinary skill in the art. In some implementations, the controller 136 may form a portion of one of the engine 102's electronic control unit (ECU), such as a safety module or a dynamics module, or may be configured as a stand-alone entity. Further, the controller 136 may include an analog to digital converter that may be configured to receive an electrical signal from the sensor 134, convert the received signal into feedback-specific format, and, thereafter, prepare the signal for processing by the processor 144, so as to be eventually verified against the pressure range 142. In some implementations, the controller 136 may include a conditioning module 166 (FIG. 2) that may receive pressure signal (in the form of an electrical signal) from the sensor 134, amplify and/or strengthen the electrical signal, so as to be subsequently delivered to the processor 144 for processing. Once appropriately conditioned and processed, the electrical signal may be delivered to the counter 138 as a pressure data.

The controller 136 may also include a timer 170 to track sensing operations of the sensor 134. In some implementations, the processor 144 may perform logical operations and process the electrical signal received from the sensor 134 over a period of time (e.g. every 20 milliseconds (ms) duration), as may be regulated by the timer 170. A different time duration may also be contemplated. As with the sensor 134, the controller 136 may also source power from an equipment, such as an ECU (not shown) of the machine 100.

In some implementations, counter 138 may be an accumulator. The counter 138 may be configured to receive a pressure of the fluid from the sensor 134 as a pressure data, as noted above. The counter 138 may be configured to generate the counter value that may be increased or decreased based on whether the pressure data exceeds the pressure range 142, as may be verified by the controller 136. The counter 138 may include a counter circuit 174 that may be adapted to count in a forward direction (or facilitate increment) from a current counter value or a zero reference count (see line 178, second chart 154). Similarly, the counter circuit 174 may be adapted to count in a reverse direction (or facilitate decrement) relative to the current counter value. For the purposes of the present disclosure, a count instance may refer to a single increment/decrement occurrence as executed by the counter 138. A count in a forward direction may refer to an increase in the counter value, for example, increasing positively in magnitude in a direction away from zero (see direction, A). Similarly, a count in a reverse direction may refer to a decrease in the counter value, for example, decreasing in magnitude towards zero (see direction, B). In some implementations, a sensing unit (not shown) may be coupled to the counter circuit 174 to sense a change in the counter value in either directions, and this sensing unit may also be coupled to the controller 136 to deliver information pertaining to said change.

The counter value of the counter 138 may operate based on an integer function that may be incremented according to a regularly varied progression, such as 100, 200, 300, and so on. Similarly, the counter value may be decremented according to a regularly varied progression of 300, 280, 260, and so on. In some implementations, the counter value may vary according to any arithmetic, geometric, or harmonic progression, so as to help the controller 136 infer an unacceptable pressure noise (such as unacceptable pressure noise 164). In one example, an increment formulated within the controller 136 may include a regularly varied progression defined by the first amount (e.g., 100), and similarly, a decrement formulated within the controller 136 may include a regularly varied progression defined by the second amount (e.g., 20).

The counter 138 may be a digital device, and the count instances may be stored as digital values in the memory 146 of the controller 136, although it may be possible for the count instances to be stored within an independent memory associated with the counter 138. The count instances may be accessed by the processor 144 for determining when the count instances have exceeded a predetermined counter threshold value in either of the forward direction or in the reverse direction. For example, the predetermined counter threshold value may be categorized into a threshold value and an auxiliary threshold value. If the counter value of the counter 138 exceeds the threshold value, the controller 136 may generate an alert and may cause the alert to be displayed via the display 140. The controller 136 may also log an event based on the counter 138 exceeding the threshold value. If the counter value of the counter 138 is detected by the controller 136 to have decremented to a value that is less than the auxiliary threshold value, the controller 136 may clear the alert. In some implementations, the threshold value and the auxiliary threshold value may be respectively referred to as—an event activation threshold value (see line 182, second chart 154) and an event deactivation threshold value (see line 184, second chart 154). In some implementations, the event deactivation threshold value (see line 184, second chart 154) may be different (or lower) than the event activation threshold value (see line 182, second chart 154), although it may be possible that these threshold values may remain same in certain situations or applications. In some implementations, the event deactivation threshold value (see line 184, second chart 154) may be higher than the event activation threshold value (see line 182, second chart 154). As an example, the event activation threshold value (see line 182, second chart 154), as may be summated by the increment amount (e.g., 100) for a series of incremented count instances, may be 500. Similarly, the event deactivation threshold value (see line 184, second chart 154), as may be deducted by the decrement amount (e.g., 20) for a series of decremented count instances, may be 100. Accordingly, if the pressure exceeds the pressure range 142 and the counter value of the counter 138 attains a value of 500 or more, a response signal may be generated, which may be sent to the controller 136 for generating an alert and notifying an operator, through the display 140 of an unacceptable pressure noise (such as unacceptable pressure noise 164) and a cavitation condition. Similarly, when the pressure does not exceed the pressure range 142 and the counter 138 drops to a value of or below 100, a response signal may be generated within the counter 138, which may be sent to the controller 136 for clearing the alert from the display 140.

Referring again to FIG. 3, the controller 136 may be configured to log an event based on one or both—the generation of the alert and/or clearing of the alert. Exemplary events are denoted in FIG. 3—see third chart 156, first event 188, and second event 190, marked respectively between lines 192, 194 and 196, 198). Such alerts may be applicable for later use by a back office. As an example, events 188, 190 may help study a pattern of pressure variations occurring during a cycle of the fluid system 106's operation. As may be seen from the second chart 154, the events 188, 190 respectively may include curves 200, 202 (generated by the controller 136), respectively representing a progress of the events 188, 190. For curve 200, as the counter value of the counter 138 exceeds the event activation threshold value (see line 182, second chart 154), and subsequently drops to the event deactivation threshold value (see line 184, second chart 154), the controller 136 may log or register an event with the memory 146. In effect, an event (such as the first event 188) may be logged by either generating the alert, clearing the alert, or both. Nevertheless, the events 188, 190 may also be logged or registered by only generating the alert, or by only clearing the alert, as well. A similar event registration protocol may be contemplated for curve 202, as well (i.e. for the second event 190).

In some implementations, the decrement amount may be less than the increment amount, as may be understood by the example above. Alternatively, the decrement amount may be equal to the increment amount. Alternatively, the decrement amount may be greater than the increment amount. Additionally, or alternatively, the increment amount and the decrement amount may be based on characteristics of the machine 100 as well. These characteristics may include a type and capacity of the engine 102, for example. In some implementations, characteristics of the machine 100 may depend upon a fluid used by the fluid system 106. For example, a fluid, such as a transmission fluid, used in a fluid system of one machine may differ from a transmission fluid used in a fluid system of another machine, and one or more of a viscosity, operating pressure, temperature, and/or the like of the fluid, may form characteristics of the machine 100, resulting in alternate increment and decrement amounts. Additionally, or alternatively, the threshold values (event activation threshold value (line 182) and event deactivation threshold value (line 184)) that trigger the logging or registration of the event may be based on such characteristics of the machine 100 as well.

In brevity, every time the counter 138 exceeds the event activation threshold value (line 182), the presence of an unacceptable pressure noise (such as unacceptable pressure noise 164), or a cavitation condition within the fluid system 106, may be determined. As a result, the controller 136 may generate the alert via the display 140. Upon clearing the alert, it may be understood that the 'cavitation condition' may be no longer present within the fluid system 106. Effectively, generating the alert generally indicates that the pressure of the fluid is exceeding the pressure range 142 (or is not within the pressure range 142), while clearing the alert may indicate that the pressure of the fluid is returning to the pressure range 142 (or is within the pressure range 142).

The display 140 may be an alerting device or an annunciation device that may be coupled to the controller 136. The display 140 may be configured to provide a cavitation alert every time the counter 138 exceeds the event activation threshold value (see line 182, second chart 154). To this end, the display 140 may be a visual display such as a light emitting diode (LED), a bulb, or a pop-up window displayed via touchscreens, liquid crystal displays (LCDs), and which may be in ready access, such as visually, to an operator. The display 140 may also include an audible device such as a speaker or an alarm, suitably incorporated within an operator's vicinity. In some implementations, the display 140 may also be a combination of both an audible device and a visual display. In some implementations, it may be possible that the display 140 may transmit one or more alerts to a remote station or a back office so that multiple operators and stakeholders, involved directly or indirectly in an operation of the fluid system 106, may be informed of an unacceptable pressure noise (such as unacceptable pressure noise 164) and/or the 'cavitation condition' existing (or persisting in some cases) within the pump 122 or the fluid system 106.

INDUSTRIAL APPLICABILITY

Figure 4:
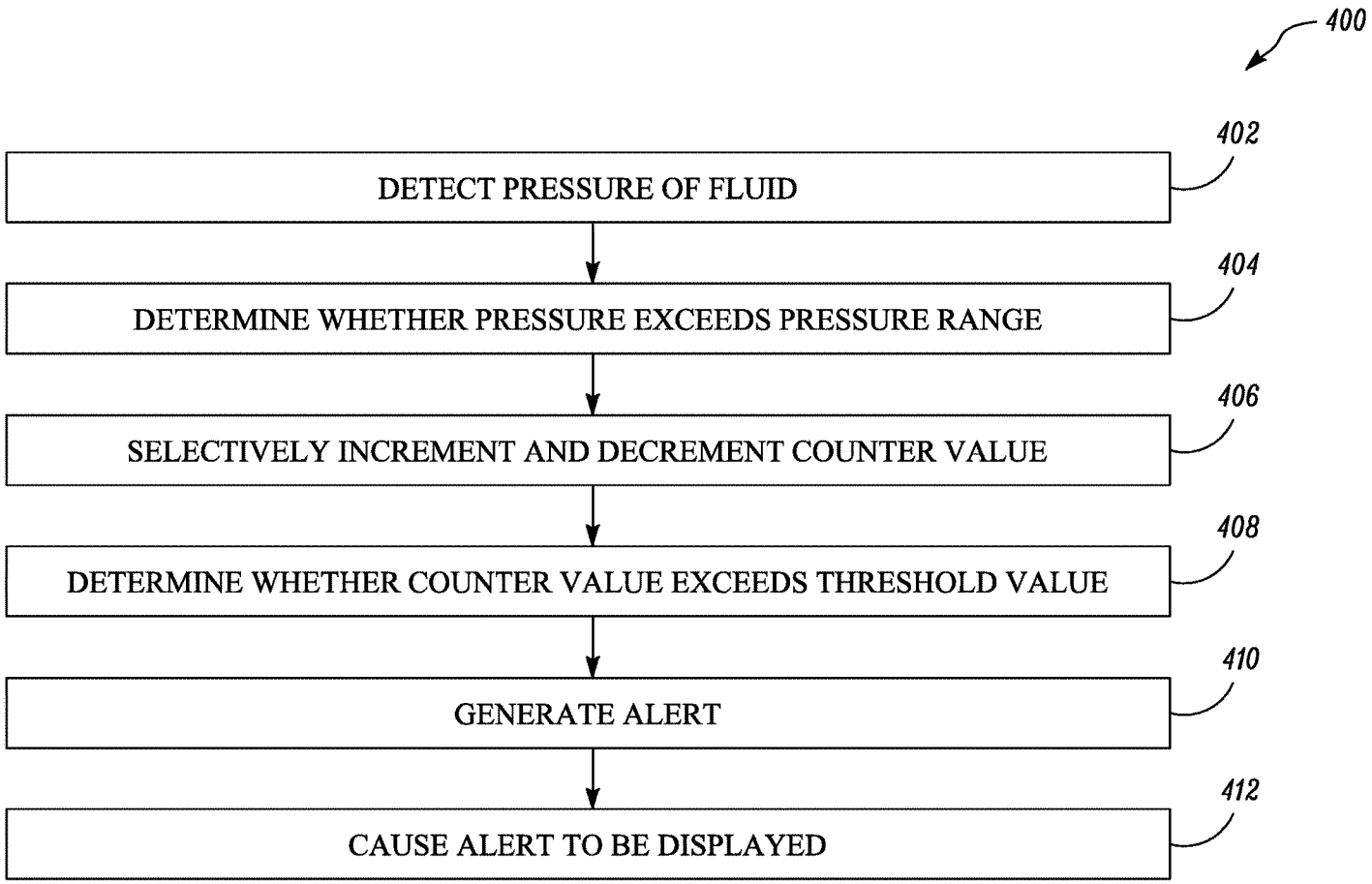
FIG. 4 is a flowchart depicting an exemplary method of operation of the pump cavitation detection system, in accordance with concepts of the present disclosure.

Referring to FIGS. 3 and 4, an exemplary method of operation of the system 124 is described. The method is explained by way of a flowchart 400 (FIG. 4). The method described may correspond to a working of the system 124 with either single or multiple pressure sensing instances. The flowchart 400 is discussed also in conjunction with FIG. 2, and is initiated at step 402.

At step 402, the sensor 134 may detect a pressure variation within the fluid system 106 and may produce an electrical signal, slated for delivery to the controller 136. This pressure signal may be detected at the outlet 130, or at a portion generally upstream of the outlet 130 so that a fluid pressure being pumped by the pump 122 may be monitored. The sensor 134 may perform a detecting operation either continuously, or according to a set pattern defined within the controller 136, enforced by the timer 170. For example, the sensor 134 may periodically detect pressure fluctuations (e.g., every 20 ms). The method proceeds to step 404.

At step 404, the controller 136 may receive the electrical signal from the sensor 134. This signal may be conditioned (strengthened or amplified as appropriate) by the conditioning module 166 and may be sent to the processor 144 for processing. The processor 144 may perform several logical operations as may be directed by the set of instructions to form the processed signal. In some implementations, the processor 144 may use the conversion module 148 to convert the electrical signal to a processed signal (or an actual value) that is readable by the set of instructions. Thereafter, the processor 144 may compare the processed signal with the pressure range 142. Based on determining whether the processed signal (pressure) exceeds, falls outside, or is not within the pressure range 142, the processed signal may be sent to the counter 138. The method proceeds to step 406.

At step 406, the controller 136 may vary the counter value of the counter 138 such that the counter value of the counter 138 may be selectively incremented or decremented, respectively by the increment amount or the decrement amount noted above. For example, the counter value may be incremented when the pressure is not within (e.g., exceeds) the pressure range 142, while the counter value may be decremented when the pressure is within the pressure range 142 (or is less than the pressure range 142). The method proceeds to step 408.

At step 408, in the event of successive pressure readings that exceed or fall outside of the pressure range 142, the controller 136 may increment the counter value of the counter 138 for each of those successive readings (or count instances). When the count instances (or the counter value)

meet or exceed the event activation threshold value (see line 182, second chart 154), as determined by the controller 136, the counter 138 may generate and transmit a response signal to the controller 136. The method proceeds to step 410.

At step 410, the controller 136 may process the response signal by using the processor 144, and because the counter 138 has exceeded the event activation threshold value (see line 182, second chart 154), the controller 136 may generate an alert. The method proceeds to step 412.

At step 412, the controller 136 may transmit the alert to the display 140, and cause the alert to be displayed on the display 140. In so doing, the controller 136 may detect an unacceptable pressure noise (such as unacceptable pressure noise 164) and/or a cavitation condition within the fluid system 106 and/or the pump 122. The controller 136 may also log an event based on the alert in the memory 146. Alternatively, the controller 136 may determine that a fluid level in fluid system 106 may be low, and that it may be time for fluid change. Optionally, when the alert is generated, the controller 136 may also be configured to derate or shut down the engine 102.

If successive pressure signals fall within (or does not exceed) the pressure range 142, the controller 136 may successively decrement the counter 138 by the decrement amount. With such decrements, the counter value of the counter 138 may eventually meet and/or recede below the event deactivation threshold value (see line 184, second chart 154). Such a situation may be indicative of a normal pressure state within the fluid system 106 and/or the pump 122. As a result, the controller 136 may clear the alert, and may thereafter determine a 'no cavitation condition' state within the fluid system 106.

In some implementations, events 188, 190 may be inhibited from being logged in the memory 146. For example, when a transmission shift within the fluid system 106 may be in process for achieving a different torque ratio between torque received from the engine 102 and torque supplied to the traction devices 112 of the machine 100; or unless the engine 102 has been active for a predetermined period (for example, 60 seconds) and has achieved a threshold engine speed (machine 100 is operating); or unless a temperature of the fluid meets a threshold fluid temperature (machine 100 is running); the system 124 may refrain from logging any event corresponding to a 'cavitation condition'. Each of the states of the machine 100, i.e. when the machine 100 may be running or operating, or when the engine 102 has been active for a predetermined period, or when a transmission shift may be in process, may be determined by the controller 136 after detecting the pressure.

Given the increment and decrement functions of the counter 138, the 'cavitation condition' may be detected by analyzing an unacceptable pressure noise (such as unacceptable pressure noise 164) or a noisy pressure signal existent within the fluid system 106 and/or the pump 122. Such pressure noise may serve as an early notification mechanism against an impending pump failure. Such a mechanism may be different from the application of level sensors or point sensors, since level sensors and point sensors may only indicate a low fluid level. The fluid system 106 of the present disclosure may be also distinct in operation from conventional pressure sensors, since conventional pressure sensors may only detect fluid pressures, but are often indicators of a fluid leak than cavitation.

In some implementations, it may be possible that the fluid system 106 may work without one or more of the above disclosed elements and components. Moreover, an interconnection between each of the components may be varied as well. For example, it may be possible that the sensor 134 may communicate a direct signal to the counter 138, by bypassing the controller 136, and that the counter 138 may include a memory and a control system independent of the controller 136 to process, store, and transmit signals to the controller 136, for further processing. Additionally, a signal data obtained from the sensor 134 may be logged for later use, as well. In some implementations, the counter 138 may be built-in to the controller 136, and both the counter 138 and the controller 136 may be an integral unit. It will be understood that several of these variations may naturally occur and be implemented by someone in the art, and each such variation may fall within the ambit of the present disclosure.

It should be understood that the above description is intended for illustrative purposes only and is not intended to limit the scope of the present disclosure in any way. Thus, one skilled in the art will appreciate that other aspects of the disclosure may be obtained from a study of the drawings, the disclosure, and the appended claim.

What is claimed is:

1. A machine comprising:

an engine, a transmission fluid system coupled to the engine and configured to receive a fluid to power a movement of the machine, the fluid system including:

a pump configured to pump the fluid within the fluid system;

a sensor configured to detect a pressure of the fluid being pumped by the pump;

a counter coupled to the sensor and configured to receive the pressure as a pressure signal, the counter configured to generate a counter value; and a controller coupled to the sensor and the counter, the controller configured to:

determine whether the pressure exceeds a pressure range;

selectively increment or decrement the counter value based on determining whether the pressure exceeds the pressure range, the counter value being incremented when the pressure exceeds the pressure range, the counter value being decremented when the pressure does not exceed the pressure range;

determine whether the counter value exceeds a threshold value;

generate an alert when the counter value exceeds the threshold value; and a display coupled to the controller and configured to display the alert.

2. The machine of claim 1, wherein the controller is configured to determine whether the machine is operating or running after detecting the pressure.

3. The machine of claim 1, wherein the controller is configured to clear the alert upon detecting that the counter value has been decremented to a value that is less than an auxiliary threshold value, the auxiliary threshold value being lower than the threshold value.

4. The machine of claim 3, wherein the controller is configured to log an event by at least one of generating the alert and clearing the alert.

5. The machine of claim 1, wherein the controller is configured to increment the counter value by a first amount and decrement the counter value by a second amount, the second amount being less than the first amount.

6. The machine of claim 1, wherein the controller is configured to determine the pressure range as a factor of a nominal pressure of operation of the fluid.

7. A transmission fluid system, comprising:

a pump configured to pump a fluid within the fluid system;

a sensor configured to detect a pressure of the fluid being pumped by the pump;

a counter coupled to the sensor and configured to receive the pressure as a pressure signal, the counter configured to generate a counter value; and a controller coupled to the sensor and the counter, the controller configured to:

determine whether the pressure exceeds a pressure range;

selectively increment or decrement the counter value based on determining whether the pressure exceeds the pressure range, the counter value being incremented when the pressure exceeds the pressure range, the counter value being decremented when the pressure does not exceed the pressure range;

determine whether the counter value exceeds a threshold value;

generate an alert when the counter value exceeds the threshold value; and a display coupled to the controller and configured to display the alert.

8. The fluid system of claim 7, wherein the pump is included in a machine, and the controller is configured to determine whether the machine is operating or running after detecting the pressure.

9. The fluid system of claim 7, wherein the controller is configured to increment the counter value by a first amount and decrement the counter value by a second amount, the second amount being less than the first amount.

* * * * *